US011986077B2

(12) United States Patent
Chen

(10) Patent No.: US 11,986,077 B2
(45) Date of Patent: May 21, 2024

(54) COSMETIC CONTAINER

(71) Applicant: Glaspray Engineering & Manufacturing Co., Ltd., Tainan (TW)

(72) Inventor: Chia-Te Chen, Tainan (TW)

(73) Assignee: GLASPRAY ENGINEERING & MANUFACTURING CO., LTD., Tainan (TW)

( * ) Notice: Subject to any disclaimer, the term of this patent is extended or adjusted under 35 U.S.C. 154(b) by 232 days.

(21) Appl. No.: 17/711,650

(22) Filed: Apr. 1, 2022

(65) Prior Publication Data

US 2023/0309678 A1 Oct. 5, 2023

(51) Int. Cl.
*A45D 33/16* (2006.01)

(52) U.S. Cl.
CPC ..... *A45D 33/16* (2013.01)

(58) Field of Classification Search
CPC ..... A45D 34/00; A45D 40/04; A45D 40/205; A45D 40/065; A45D 40/06; A45D 40/02; A45D 2040/0025; A45D 33/22; A45D 33/28; A45D 33/16
USPC ..... 222/159, 183, 160; 206/581
See application file for complete search history.

(56) References Cited

U.S. PATENT DOCUMENTS

| | | | | |
|---|---|---|---|---|
| 9,271,555 | B1 * | 3/2016 | Chen | A45D 40/24 |
| 9,277,797 | B2 * | 3/2016 | Chen | A45D 34/00 |
| 2015/0102123 | A1 * | 4/2015 | Nichols | A61M 15/08 239/34 |
| 2016/0037890 | A1 * | 2/2016 | Chen | B05B 11/0032 222/154 |
| 2016/0073765 | A1 * | 3/2016 | Thompson | A45D 40/205 401/55 |
| 2019/0029398 | A1 * | 1/2019 | Zhang | A45D 40/00 |
| 2021/0076803 | A1 * | 3/2021 | Trochel | A45D 40/16 |
| 2021/0369902 | A1 | 12/2021 | Hasegawa | |

FOREIGN PATENT DOCUMENTS

| | | | |
|---|---|---|---|
| CN | 213045859 | U | 4/2021 |
| EP | 2893833 | A1 | 7/2015 |
| FR | 3111056 | A1 | 12/2021 |
| KR | 200416531 | Y1 | 5/2006 |
| TW | M530068 | U | 10/2016 |
| TW | M550078 | U | 10/2017 |
| TW | I673022 | B | 10/2019 |
| WO | 2015144868 | A1 | 10/2015 |

* cited by examiner

*Primary Examiner* — Chun Hoi Cheung
(74) *Attorney, Agent, or Firm* — Brad J. Thorson; DeWitt LLP

(57) ABSTRACT

A cosmetic container has a container body, an upper casing, and a lower casing. The container body has an upper housing and a lower housing being rotatable relative to each other. The upper casing is detachably and orientationally sleeved on the upper housing to rotate the upper housing with the upper casing. The lower casing is detachably and orientationally sleeved on the lower housing to rotate the lower housing with the lower casing. Because the upper casing and the lower casing are orientationally mounted around the upper housing and the lower housing, respectively, variety and variability in appearance of the cosmetic container can be provided without affecting its functional operation. Marks, textures, and patterns on an external surface of the container body can be protected.

9 Claims, 7 Drawing Sheets

COSMETIC CONTAINER

BACKGROUND OF THE INVENTION

1. Field of the Invention

The present invention relates to a cosmetic container, and more particularly to a cosmetic container for containing cosmetic products.

2. Description of the Prior Art

Cosmetics are daily necessities for skin care or beauty. For quality and style, cosmetics are contained in cosmetics containers with high quality or fancy appearances in the market to attract customers to purchase or collect them.

A conventional rotary cosmetic container sold on the market comprises a rotary driving assembly and a containing body. The rotary driving assembly comprises an upper housing and a lower housing connected with a rotary mechanism. The lower housing is rotatably mounted below the upper housing. The containing body is mounted in the upper housing and is connected with the rotary mechanism. The upper housing is held by one of two hands of a customer and the lower housing is rotated by the other hand of the customer to drive the rotary mechanism to move the containing body to extend out from a top of the upper housing or retract into the upper housing.

In order to ensure the operation of the above-mentioned cosmetic container to move the containing body to extend out from the top of the upper housing, patterns or textures can only be printed or disposed on the external surfaces of the upper housing and the lower housing of the rotary driving assembly. So the appearance of the above-mentioned cosmetic container is limited by functional requirement. Accordingly, the appearance of the above-mentioned cosmetic container is dull and regular and is not appealing to customers.

In addition, to indicate product information, e.g. ingredients, some manufacturers will print the product information directly on the external surfaces of the upper housing and the lower housing of the above-mentioned cosmetic container. However, after long-term use and operation, the product information, patterns, or textures printed on the external surfaces of the upper housing and the lower housing are easily peeled off by repeated touch and operation by hands contaminated with cosmetics. Consequently, the product information becomes difficult to recognize after long-term use, and that even reduces attraction of the appearance of the above-mentioned cosmetic container.

Therefore, how to enhance variability in appearance of the cosmetic container and prevent the product information or the patterns printed on the external surfaces thereof from peeling off without affecting its functional operation is an objective needs to be improved.

To overcome the shortcomings, the present invention provides a cosmetic container to mitigate or obviate the aforementioned problems.

SUMMARY OF THE INVENTION

The main objective of the present invention is to provide a cosmetic container, to mitigate a problem that an appearance of the conventional cosmetic container is limited by functional requirement, is dull and regular, and is not easy to attract customers, and to mitigate a problem that product information, patterns, or textures printed on an external surface of the conventional cosmetic container are easily peeled off after long-term use.

The cosmetic container of the present invention comprises a container body, an upper casing, and a lower casing. The container body has an upper housing and a lower housing being rotatable relative to each other. The upper housing has a first positioning structure formed in an external surface of the upper housing near a top of the upper housing. The lower housing has a second positioning structure formed in an external surface of the lower housing near a bottom of the lower housing. The upper casing is detachably sleeved on and surrounds the upper housing of the container body and has an opening formed in a top of the upper casing and a first engaging structure formed in an internal surface of the upper casing and orientationally engaged with the first positioning structure to rotate the upper housing with the upper casing. The lower casing is detachably sleeved on and surrounds the lower housing of the container body and has a second engaging structure formed in an internal surface of the lower casing and orientationally engaged with the second positioning structure to rotate the lower housing with the lower casing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
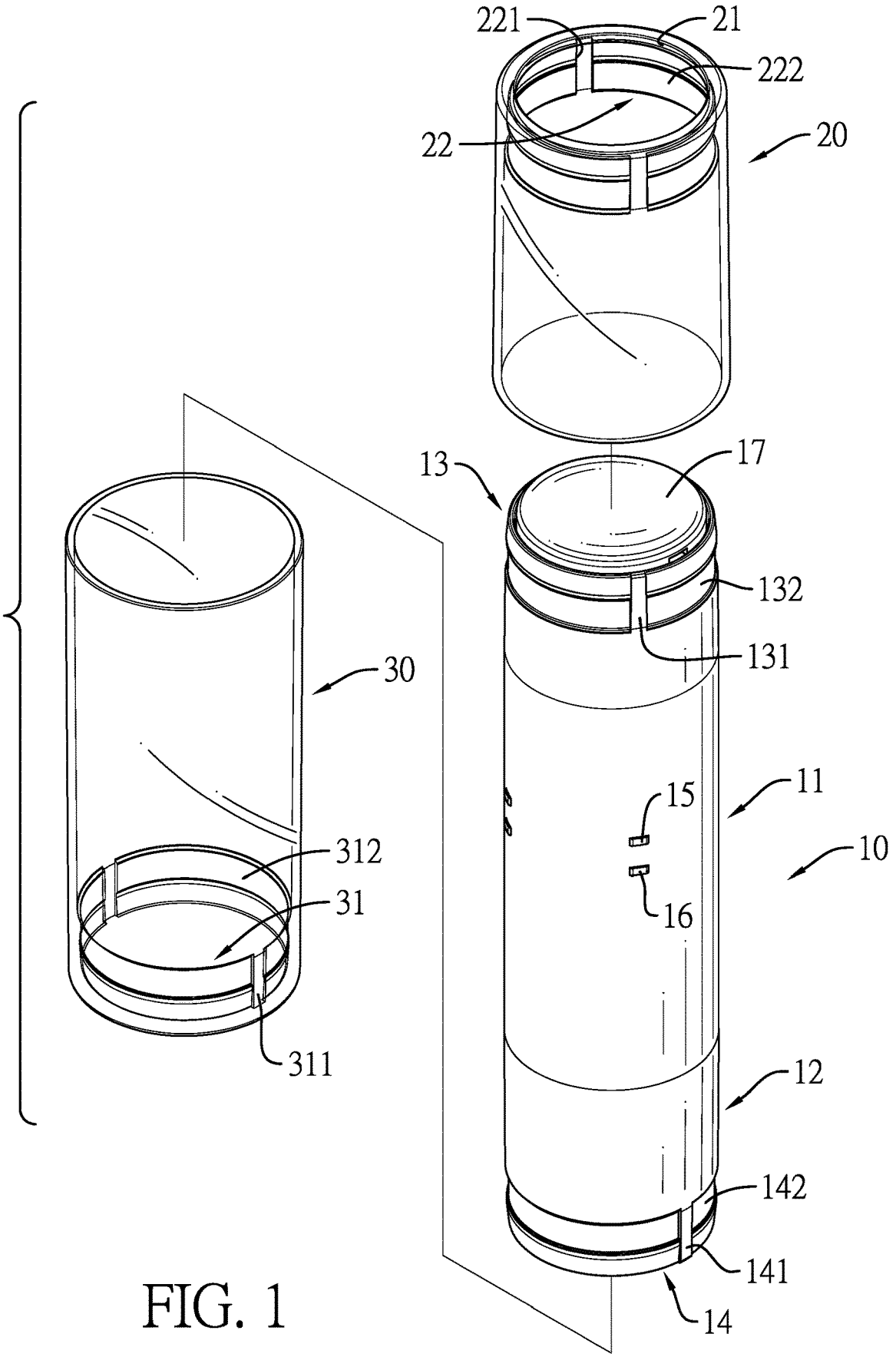
FIG. 1 is an exploded perspective view of a cosmetic container in accordance with the present invention.
Figure 2:
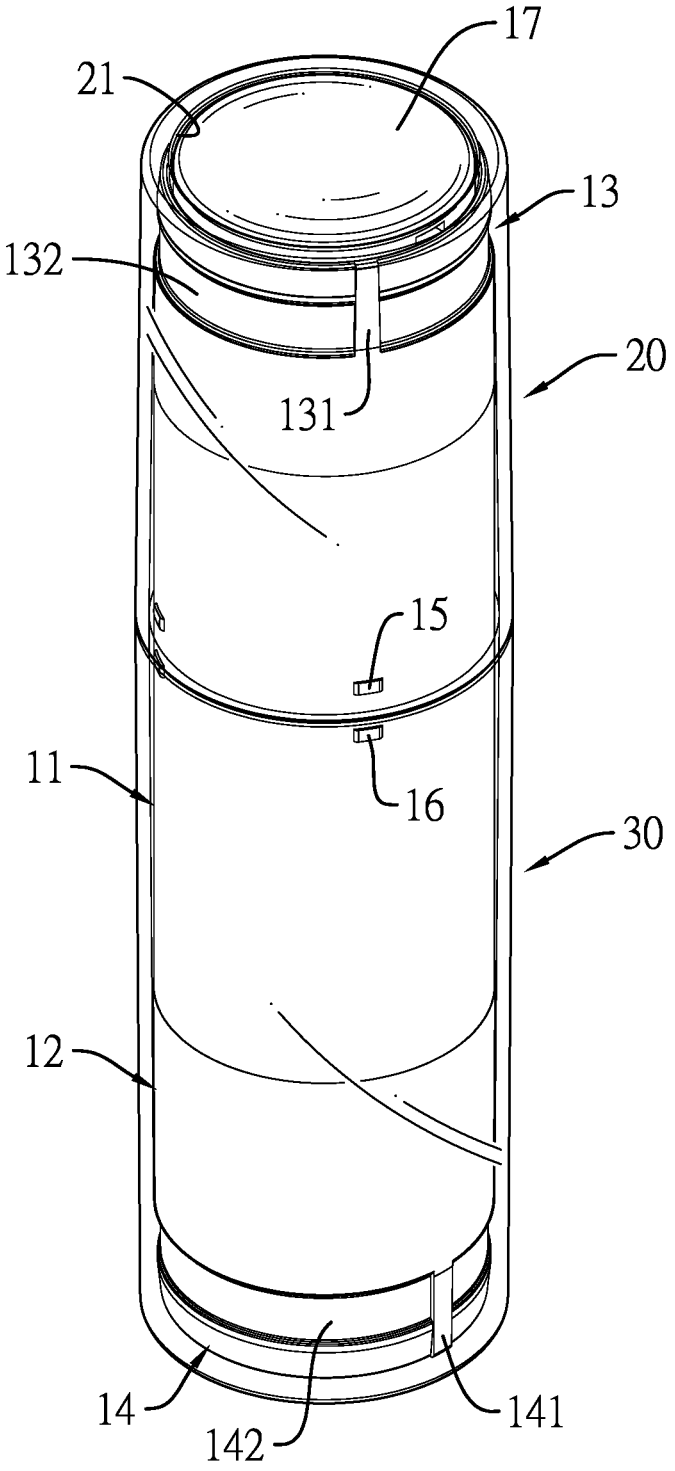
FIG. 2 is a perspective view of the cosmetic container in FIG. 1 showing a closed condition.
Figure 3:
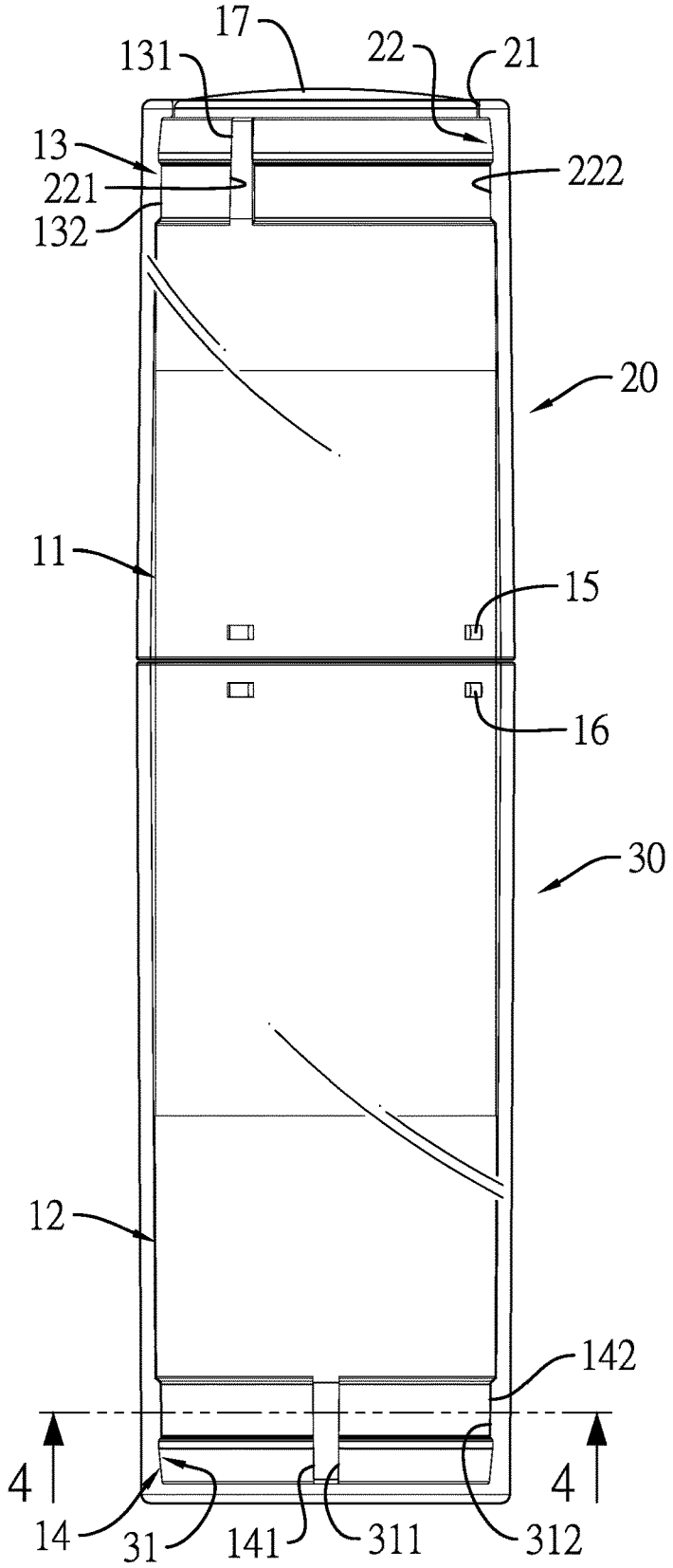
FIG. 3 is a side view of the cosmetic container in FIG. 1.
Figure 4:
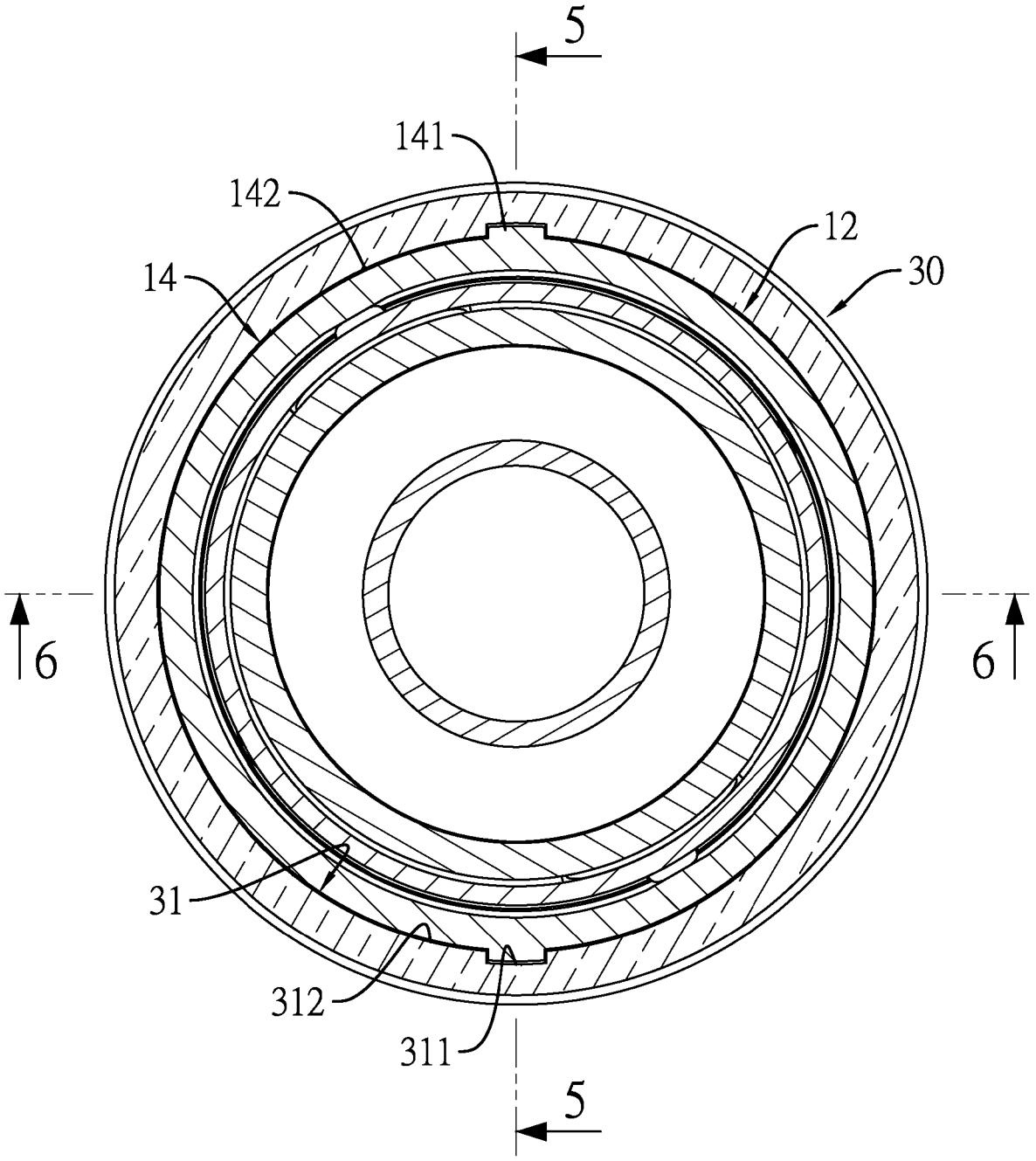
FIG. 4 is an enlarged cross sectional end view of the cosmetic container along line 4-4 in FIG. 3.
Figure 5:
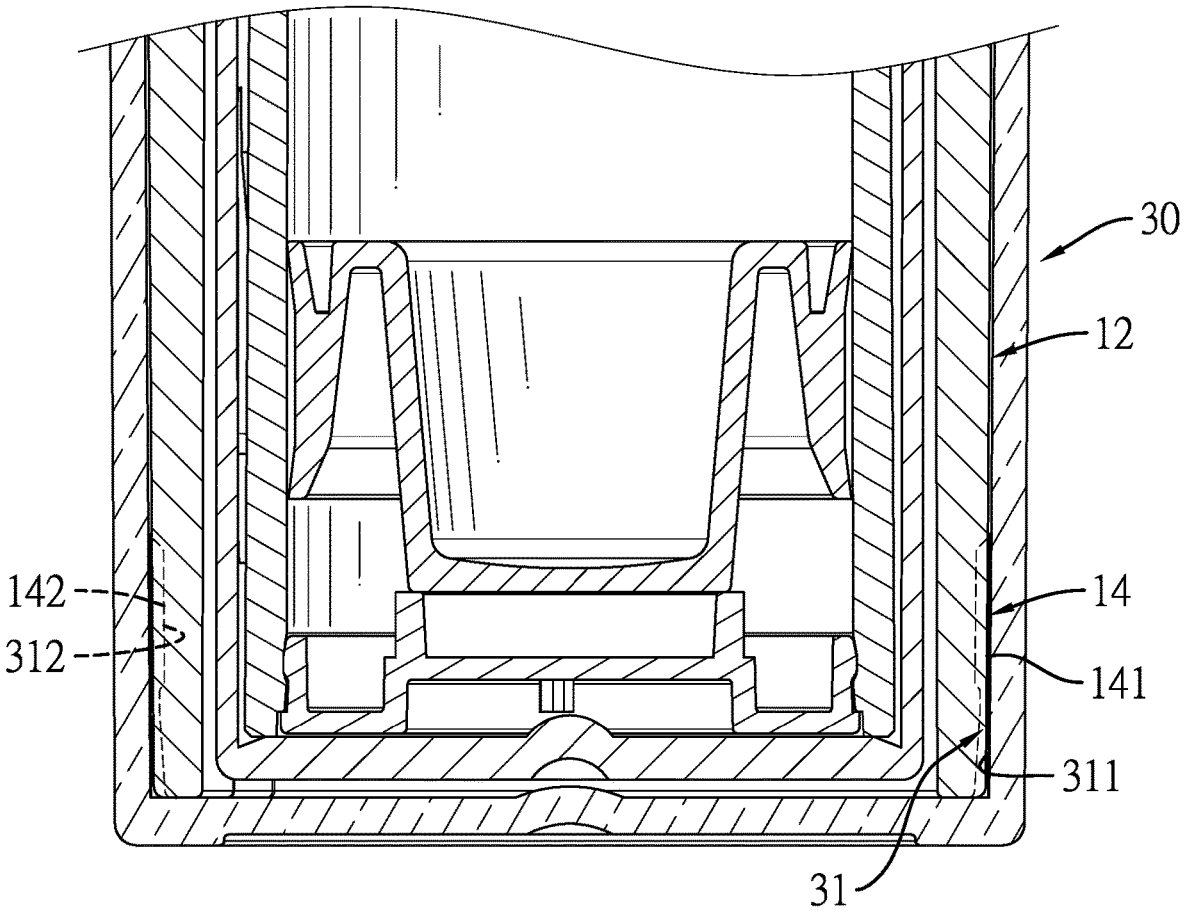
FIG. 5 is an enlarged cross sectional side view of the cosmetic container along line 5-5 in FIG. 4.

With reference to FIGS. 1 to 3, a cosmetic container in accordance with the present invention comprises a container body 10, an upper casing 20, and a lower casing 30.

Figure 7:
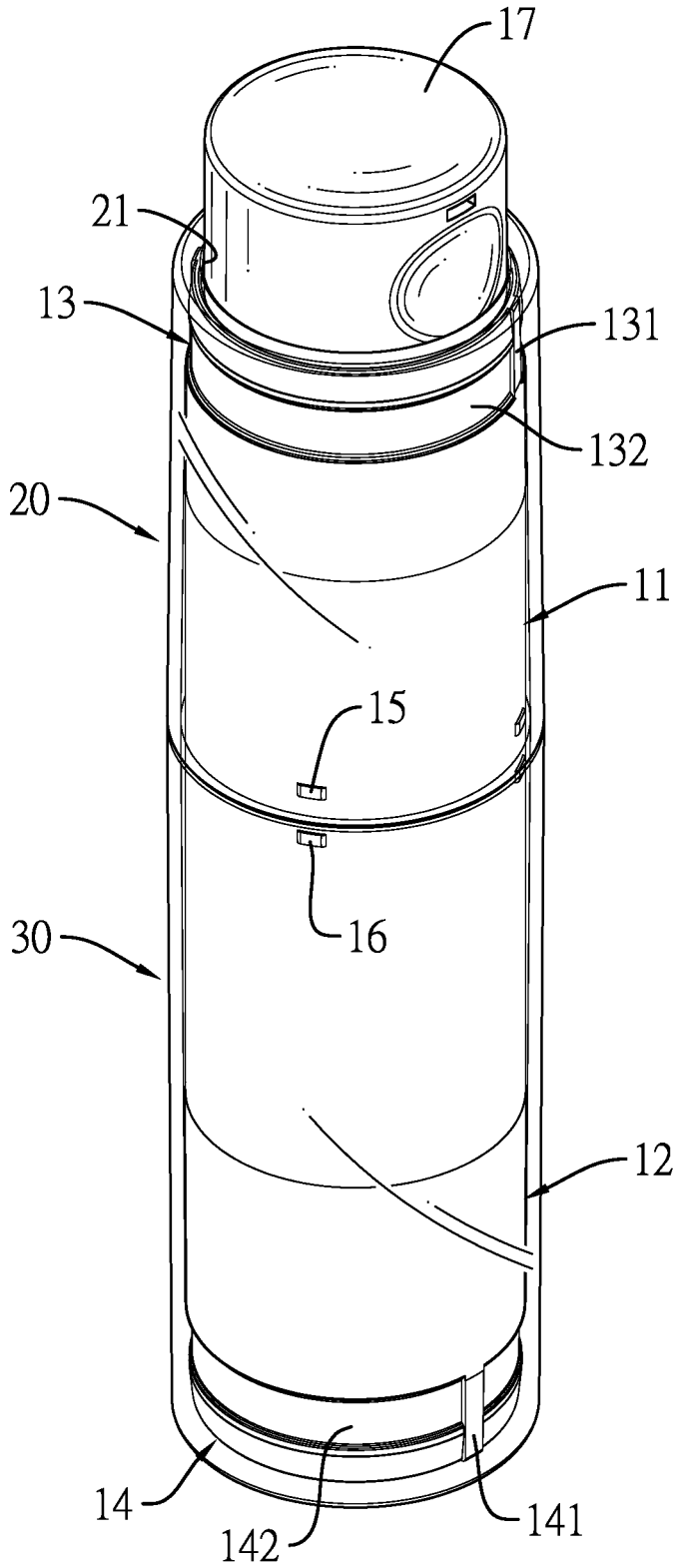
FIG. 7 is an operational perspective view of the cosmetic container in FIG. 1 showing an open condition.

With reference to FIGS. 1 and 2, the container body 10 has an upper housing 11 and a lower housing 12 being rotatable relative to each other. The upper housing 11 has a first positioning structure 13 formed in an external surface of the upper housing 11 near a top of the upper housing 11. The lower housing 12 has a second positioning structure 14 formed in an external surface of the lower housing 12 near a bottom of the lower housing 12. As shown in FIGS. 2 and 7, the container body 10 has a pressing seat 17 mounted in the upper housing 11. When the lower housing 12 is rotated relative to the upper housing 11, the pressing seat 17 is moved to extend out from the top of the upper housing 11 to an open position as shown in FIG. 7 or is retracted into the top of the upper housing 11 to a closed position as shown in FIG. 2.

With reference FIGS. 1, 2, and 7, the upper casing 20 is detachably sleeved on and surrounds the upper housing 11 of the container body 10 and has an opening 21 formed in a top of the upper casing 20 for the pressing seat 17 to pass therethrough. The upper casing 20 has a first engaging structure 22 formed on an internal surface of the upper casing 20 and orientationally engaged with the first positioning structure 13 of the upper housing 11 to rotate the upper housing 11 with the upper casing 20.

With reference to FIGS. 1 and 2, the lower casing 30 is detachably sleeved on and surrounds the lower housing 12 of the container body 10. The lower casing 30 has a second engaging structure 31 formed on an internal surface of the lower casing 30 and orientationally engaged with the second positioning structure 14 to rotate the lower housing 12 with the lower casing 30.

With reference to FIGS. 3 to 6, the first positioning structure 13 has at least one positioning rib 131 formed on and longitudinally extending along the external surface of the upper housing 11. The second positioning structure 14 has at least one positioning rib 141 formed on and longitudinally extending along the external surface of the lower housing 12. The first engaging structure has at least one positioning groove 221 formed in and longitudinally extending along the internal surface of the upper casing 20. The second engaging structure 31 has at least one positioning groove 311 formed in and longitudinally extending along the internal surface of the lower casing 30. The at least one positioning rib 131 of the first positioning structure 13 is mounted in and engaged with the at least one positioning groove 221 of the first engaging structure 22. The at least one positioning rib 141 of the second positioning structure 14 is mounted in and engaged with the at least one positioning groove 311 of the second engaging structure 31.

With reference to FIGS. 3 to 6, the first positioning structure 13 has an engaging groove 132 formed in and transversally extending along the external surface of the upper housing 11. The second positioning structure 14 has an engaging groove 142 formed in and transversally extending along the external surface of the lower housing 12. The first engaging structure 22 has at least one engaging block 222 formed on and transversally extending along the internal surface of the upper casing 20. The second engaging structure 31 has at least one engaging block 312 formed on and transversally extending along the internal surface of the lower casing 30. The at least one engaging block 222 of the first engaging structure 22 is mounted in and engaged with the at least one engaging groove 132 of the first positioning structure 13. The at least one engaging block 312 of the second engaging structure 31 is mounted in and engaged with the at least one engaging groove 142 of the second positioning structure 14.

With reference to FIGS. 1 to 3, the container body 10 has multiple first abutting blocks 15 and multiple second abutting blocks 16 formed on and protruding from an external surface of the container body 10. The first abutting blocks 15 are arranged around the external surface of the container body 10 at angular intervals and abut against the internal surface of the upper casing 20. The second abutting blocks 16 are located below the first abutting blocks 15, are arranged around the external surface of the container body 10 at angular intervals, and abut against the internal surface of the lower casing 30. Preferably, the multiple first abutting blocks 15 and the multiple second abutting blocks 16 are formed on the external surface of the upper housing 11.

When the upper casing 20 is sleeved on the upper housing 11 and the lower casing 30 is sleeved on the lower housing 12, the first abutting blocks 15 abut against the internal surface of the upper casing 20 and the second abutting blocks 16 abut against the internal surface of the lower casing 30. So the upper casing 20 and the lower casing 30 are prevented from loosening or shaking relative to the upper housing 11 and the lower housing 12 caused by gaps formed between the upper casing 20 and the upper housing 11 and formed between the lower casing 30 and the lower housing 12.

The cosmetic container in accordance with the present invention may be a cylinder, a polygonal prism, and so on. As shown in FIGS. 1 to 3, the cosmetic container is a cylinder in the embodiment. To assemble the upper casing 20 and the lower casing 30 with the container body 10, the positioning grooves 221, 311 of the first engaging structure 22 and second engaging structure 31 are respectively aligned with the positioning ribs 131, 141 of the first positioning structure 13 and the second positioning structure 14, the upper casing 20 and the lower casing 30 are pushed to mount the positioning ribs 131, 141 of the first positioning structure 13 and the second positioning structure 14 respectively into the positioning grooves 221, 311 of the first engaging structure 22 and the second engaging structure 31. The engaging blocks 222, 312 of the first engaging structure 22 and the second engaging structure 31 are pushed to respectively engage in the engaging grooves 132, 142 of the first positioning structure 13 and the second positioning structure 14.

Figure 6:
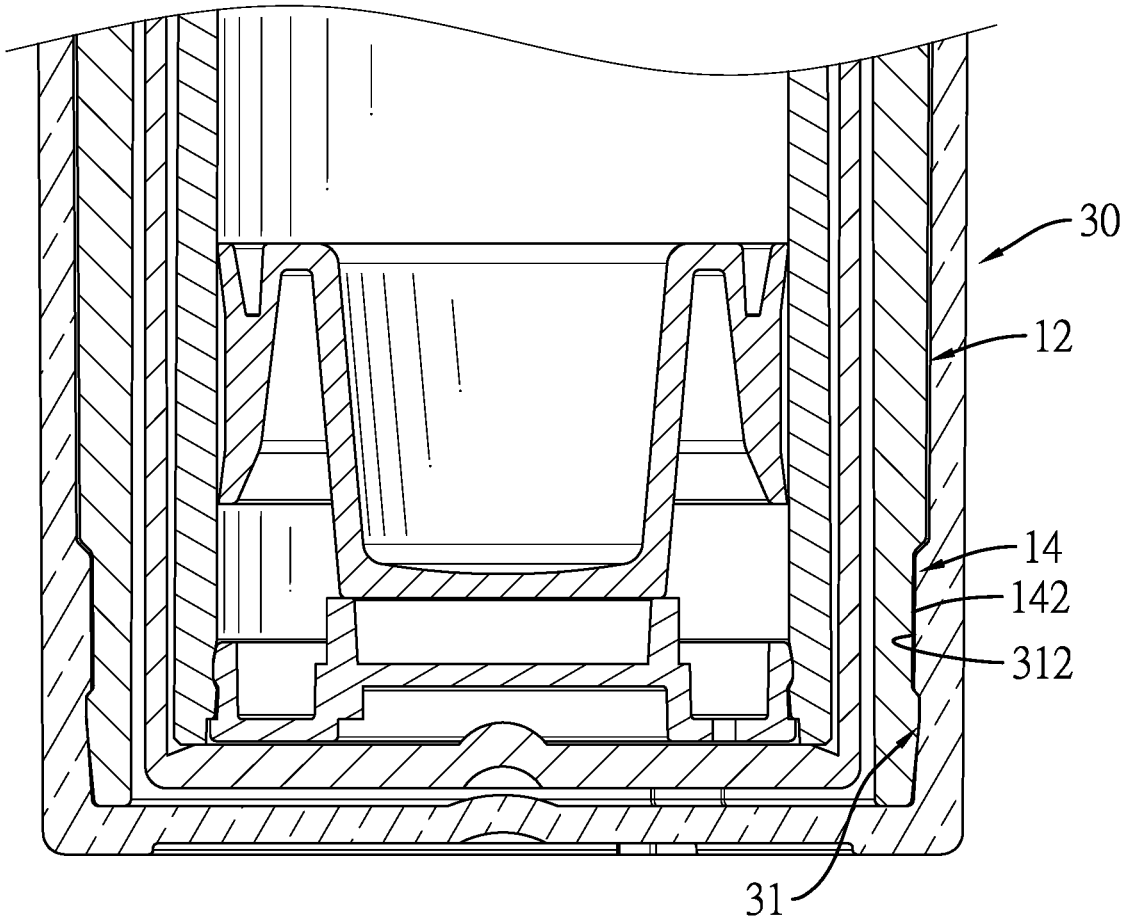
FIG. 6 an enlarged cross sectional side view of the cosmetic container along line 6-6 in FIG. 4.

With reference to FIGS. 1, 3, and 6, taking the lower casing 30 as an example, the lower casing 30 is sleeved on the lower housing 12 of the container body 10, the positioning rib 141 of the second positioning structure 14 of the lower housing 12 is mounted into the positioning groove 311 of the second engaging structure 31, and the engaging block 312 of the lower casing 30 is engaged with the engaging groove 142 of the second positioning structure 14.

With reference to FIGS. 3 to 6, with the engagement between the positioning rib 141 of the second positioning structure 14 and the positioning groove 311 of the second engaging structure 31, the lower casing 30 and the lower housing 12 are oriented with respect to each other, so the lower casing 30 is rotated with the lower housing 12. With the engagement between the engaging groove 142 of the second positioning structure 14 and the engaging block 312 of the second engaging structure 31, a longitudinal position of the lower casing 30 relative to the lower housing 12 is limited, so the lower casing 30 is not easily detached from the lower housing 12 from the longitudinal direction.

With reference to FIGS. 1 and 3, the arrangement between the first positioning structure 13 of the upper housing 11 and the first engaging structure 22 of the upper casing 20 is the same to the arrangement between the lower housing 12 and the lower casing 30, the assembling method and advantages thereof are omitted herein.

With reference to FIGS. 1, 3, 6, the upper casing 20 and the lower casing 30 are sleeved on and surround the container body 10, because of the oriented connection between the first positioning structure 13 and the first engaging structure 22, the upper casing 20 is rotated with the upper housing 11, because of the oriented connection between the second positioning structure 14 and the second engaging structure 31, the lower casing 30 is rotated with the lower housing 12. Therefore, impact to functional operation of the container body 10 caused by the upper casing 20 and the lower casing 30 is reduced.

With reference to FIG. 1, with arrangements of the upper casing 20 and the lower casing 30, the external surfaces of the upper housing 11 and the lower housing 12 of the container body 10 might be printed with patterns and textures, the external surfaces of the upper casing 20 and the lower casing 30 might be additionally printed with patterns and textures to provide variety appearance. A customer can choose the cosmetic container according to preferred upper casing 20 and lower casing 30 mounted thereon. Accordingly, variety and variability in appearance of the cosmetic container can be provided to catch customer's attention. Customization for the cosmetic container can be offered.

Moreover, the upper casing 20 and the lower casing 30 might be transparent or translucent with patterns printed thereon. While the upper casing 20 and the lower casing 30 are mounted on the container body 10, the patterns on the upper casing 20 or the lower casing 30 are layered on the patterns printed on the external surface of the container body 10 to provide a multi-layered appearance and to increase variability in appearance.

Furthermore, because the upper casing 20 and the lower casing 30 are sleeved on the container body 10, the external surface of the container body 10 is covered without affecting functional operation of the cosmetic container. Therefore, it can prevent the customer from directly touching marks, textures, or patterns on the external surface of the container body 10 during operation, and can avoid the marks, textures, or patterns peeled off from the container body 10 after prolonged use and touch.

The upper housing 11, the lower housing 12, the upper casing 20, and the lower casing 30 may be made of polyethylene terephthalate (PET), Polypropylene (PP), or Acrylonitrile Butadiene Styrene (ABS). The upper housing 11, the lower housing 12, the upper casing 20, and the lower casing 30 can be made of the same material, e.g. polyethylene terephthalate (PET), so the cosmetic container is easily recycled, which can be directly recycled without detaching the upper housing 11, the lower housing 12, the upper casing 20, and the lower casing 30 from one another to reduce sorting processes for recycling. In addition, the cosmetic container can be reused after refilling cosmetic contained in the cosmetic container to reduce waste of resource and replacement cost.

In summary, with the arrangement of the upper casing 20 and the lower casing 30, the oriented connection between the first positioning structure 13 and the first engaging structure 22, and the oriented connection between the second positioning structure 14 and the second engaging structure 31, the upper casing 20 is rotated with the upper housing 11, and the lower casing 30 is rotated with the lower housing 12. Accordingly, variety and variability in appearance of the cosmetic container can be provided without affecting its functional operation, and marks, textures, and patterns on the external surface of the container body 10 can be protected by the upper casing 20 and the lower casing 30.

What is claimed is:

1. A cosmetic container comprising:

a container body having an upper housing and a lower housing being rotatable relative to each other;

the upper housing having a first positioning structure formed in an external surface of the upper housing near a top of the upper housing; and the lower housing having a second positioning structure formed in an external surface of the lower housing near a bottom of the lower housing;

an upper casing detachably sleeved on and surrounding the upper housing of the container body and having an opening formed in a top of the upper casing; and a first engaging structure formed in an internal surface of the upper casing and orientationally engaged with the first positioning structure to rotate the upper housing with the upper casing; and a lower casing detachably sleeved on and surrounding the lower housing of the container body and having a second engaging structure formed in an internal surface of the lower casing and orientationally engaged with the second positioning structure to rotate the lower housing with the lower casing; wherein the first engaging structure has at least one positioning groove formed in and longitudinally extending along the internal surface of the upper casing;

the second engaging structure has at least one positioning groove formed in and longitudinally extending along the internal surface of the lower casing;

the first positioning structure has at least one positioning rib formed on and longitudinally extending along the external surface of the upper housing, and mounted in and engaged with the at least one positioning groove of the first engaging structure of the upper casing; and the second positioning structure has at least one positioning rib formed on and longitudinally extending along the external surface of the lower housing, and mounted in and engaged with the at least one positioning groove of the second engaging structure of the lower casing.

2. The cosmetic container as claimed in claim 1, wherein the first positioning structure has at least one engaging groove formed in and transversally extending along the external surface of the upper housing;

the second positioning structure has at least one engaging groove formed in and transversally extending along the external surface of the lower housing;

the first engaging structure has at least one engaging block formed on and transversally extending along the internal surface of the upper casing, and mounted in and engaged with the at least one engaging groove of the first positioning structure; and the second engaging structure has at least one engaging block formed on and transversally extending along the internal surface of the lower casing, and mounted in and engaged with the at least one engaging groove of the second positioning structure.

3. The cosmetic container as claimed in claim 2, wherein the container body has multiple first abutting blocks and second abutting blocks formed on an external surface of the container body;

the first abutting blocks are arranged around the external surface of the container body at angular intervals and abut against the internal surface of the upper casing; and the second abutting blocks are located below the first abutting blocks, are arranged around the external surface of the container body at angular intervals, and abut against the external surface of the lower casing.

4. The cosmetic container as claimed in claim 3, wherein the multiple first abutting blocks and the multiple second abutting blocks are formed on the external surface of the upper housing.

5. The cosmetic container as claimed in claim 1, wherein the container body has multiple first abutting blocks and second abutting blocks formed on an external surface of the container body;

the first abutting blocks are arranged around the external surface of the container body at angular intervals and abut against the internal surface of the upper casing; and the second abutting blocks are located below the first abutting blocks, are arranged around the external surface of the container body at angular intervals, and abut against the external surface of the lower casing.

6. The cosmetic container as claimed in claim 5, wherein the multiple first abutting blocks and the multiple second abutting blocks are formed on the external surface of the upper housing.

7. A cosmetic container comprising:

a container body having an upper housing and a lower housing being rotatable relative to each other;

the upper housing having a first positioning structure formed in an external surface of the upper housing near a top of the upper housing; and the lower housing having a second positioning structure formed in an external surface of the lower housing near a bottom of the lower housing;

an upper casing detachably sleeved on and surrounding the upper housing of the container body and having an opening formed in a top of the upper casing; and a first engaging structure formed in an internal surface of the upper casing and orientationally engaged with the first positioning structure to rotate the upper housing with the upper casing; and a lower casing detachably sleeved on and surrounding the lower housing of the container body and having a second engaging structure formed in an internal surface of the lower casing and orientationally engaged with the second positioning structure to rotate the lower housing with the lower casing; wherein the first positioning structure has at least one engaging groove formed in and transversally extending along the external surface of the upper housing;

the second positioning structure has at least one engaging groove formed in and transversally extending along the external surface of the lower housing;

the first engaging structure has at least one engaging block formed on and transversally extending along the internal surface of the upper casing, and mounted in and engaged with the at least one engaging groove of the first positioning structure; and the second engaging structure has at least one engaging block formed on and transversally extending along the internal surface of the lower casing, and mounted in and engaged with the at least one engaging groove of the second positioning structure.

8. The cosmetic container as claimed in claim 7, wherein the container body has multiple first abutting blocks and second abutting blocks formed on an external surface of the container body;

the first abutting blocks are arranged around the external surface of the container body at angular intervals and abut against the internal surface of the upper casing; and the second abutting blocks are located below the first abutting blocks, are arranged around the external surface of the container body at angular intervals, and abut against the external surface of the lower casing.

9. The cosmetic container as claimed in claim 8, wherein the multiple first abutting blocks and the multiple second abutting blocks are formed on the external surface of the upper housing.

* * * * *